United States Patent [19]

Moulin

[11] Patent Number: 4,586,836

[45] Date of Patent: May 6, 1986

[54] CHARACTERS CARRYING DISC FOR PRINTING MACHINE

[75] Inventor: Blaise Moulin, Corcelles, Switzerland

[73] Assignee: Caracteres S.A., Neuchatel, Switzerland

[21] Appl. No.: 577,846

[22] Filed: Feb. 7, 1984

[30] Foreign Application Priority Data

Feb. 9, 1983 [CH] Switzerland ..... 718/83

[51] Int. Cl.[4] ..... B41J 1/08; B41J 1/22

[52] U.S. Cl. ..... 400/144.2; 400/175; 101/93.19

[58] Field of Search ..... 400/139, 140, 144, 144.1, 400/144.2, 174, 175; 101/93.19, 93.18

[56] References Cited

U.S. PATENT DOCUMENTS

| | | | |
|---|---|---|---|
| 2,127,251 | 8/1938 | Fischer | 400/175 X |
| 2,969,864 | 1/1961 | Holgate | 400/175 |
| 3,878,929 | 4/1975 | Orlens et al. | 400/175 |
| 3,924,724 | 12/1975 | Kerzel | 400/175 |
| 3,986,593 | 10/1976 | Orlens et al. | 400/144.2 |
| 4,363,559 | 12/1982 | Suzuki et al. | 400/144.2 X |
| 4,465,387 | 8/1984 | Seitz et al. | 400/144.2 X |

FOREIGN PATENT DOCUMENTS

| | | | |
|---|---|---|---|
| 0038691 | 10/1981 | European Pat. Off. | 400/144.2 |
| 2818861 | 3/1979 | Fed. Rep. of Germany | 400/144.2 |
| 3140177 | 4/1983 | Fed. Rep. of Germany | 400/144.2 |
| 42657 | 4/1981 | Japan | 400/144.2 |

OTHER PUBLICATIONS

Xerox Disc. Journal, "Retainer for Daisy Print Wheel", Weisburg, vol. 2, No. 4, Jul./Aug. 1977, pp. 41–42.

IBM Tech. Disc. Bulletin, "Snap-On Coupling Between Daisy Print Wheel and Drive Shaft", Feinstein, Jr., vol. 23, No. 10, Mar. 1981, pp. 4810–4811.

*Primary Examiner*—Edgar S. Burr

*Assistant Examiner*—James R. McDaniel

*Attorney, Agent, or Firm*—Silverman, Cass & Singer

[57] ABSTRACT

The disc, made of plastic material, is provided with a circular collar coaxial with its central hole and which is provided, diametrically opposed, with two arms bent at 90°, each arm terminating with a small tongue the end of which extends beyond the said central hole. These small tongues are intended to engage an annular groove provided in the shaft of the machine at the vicinity of its end. The radial displacements of the small tongues are effected during the deformations of the arms which, due to their elasticity, return the small tongues into position.

2 Claims, 3 Drawing Figures

CHARACTERS CARRYING DISC FOR PRINTING MACHINE

BACKGROUND OF THE INVENTION

The present invention relates to a printing wheel disc for a printing machine which disc is provided with a central hole.

The object of the present invention is to furnish means which are simple, efficient, easy to be operated, reliable and inexpensive for ensuring the secured attachment of the disc to a shaft of the printing machine.

SUMMARY OF THE INVENTION

To this effect, the characters carrying disc for a printing machine according to the invention is characterized by the fact that it includes at least two small tongues, each connected to the body of the disc by a resilient, radially movable portion. The tongues extend beyond the edge of said central hole, and are intended to engage, due to their own elasticity, into a groove provided in the vicinity of the end of the shaft of the machine which projects through the hole. which projects through the hole.

The various features of the invention will be apparent from the following description, drawings and claims, the scope of the invention not being limited to the drawings themselves which are only for the purpose of illustrating specific embodiments in which the principles of the invention can be applied. Other embodiments of the invention utilizing the same or equivalent principles may be used and structural changes may be made as desired by those skilled in the art without departing from the present invention and the scope of the appended claims.

DESCRIPTION OF THE PREFERRED EMBODIMENTS

Figure 1:
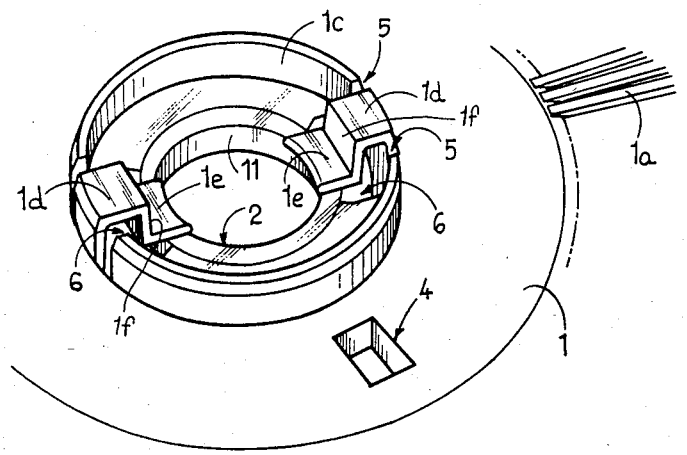
FIG. 1 is a perspective view of a part of a printing wheel disc for a printing machine, for instance an office typewriter.
Figure 2:
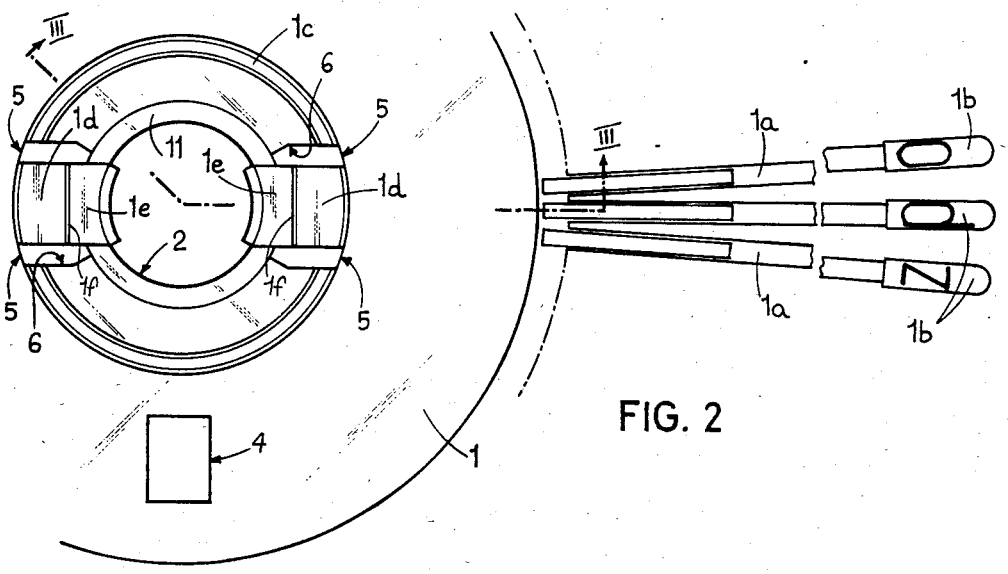
FIG. 2 is a plan view of a part of this disc drawn to a larger scale.
Figure 3:
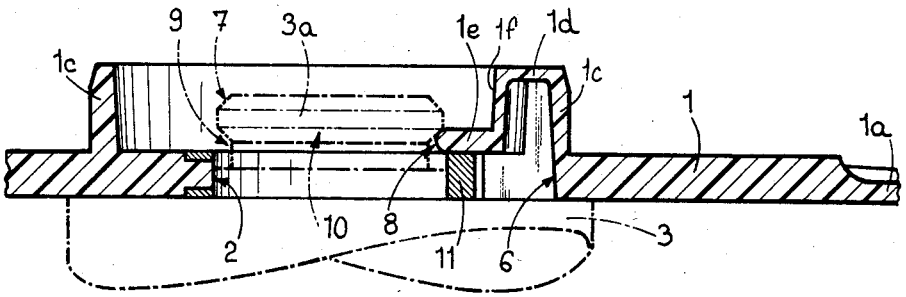
FIG. 3 is an enlarged sectional view along line III—III of FIG. 2.

Referring to FIGS. 1 to 3, the disc is preferably, made of plastic material, and is designated generally by 1. It is provided with resiliently deformable arms 1*a* carrying, at their ends, the characters designated by 1*b*. This disc is provided with a central hole 2 permitting it to be mounted on a stub journal 3*a* of the shaft 3, indicated in phantom lines, of the machine (not shown) which carries it, FIG. 3. A rectangular hole 4 is provided in disc 1 for the passage of a driving finger of the machine.

This disc is provided with a circular wall or collar 1*c*, which extends perpendicularly from the front face of the disc 1, coaxial with the central hole 2. Formed on the collar 1*c* are two diametrically opposed arms 1*d*,. The arms 1*d* radially extend inward from the top of collar 1*c* toward the hole 2. Each arm 1*d* is bent at 90° to provide a leg 1*f* which extends from the arm 1*d* toward the hole 2 and parallel to the axis of the hole 2 and collar 1*c*. Each leg 1*f* terminates in a small tongue 1*e* extending therefrom radially inward in a plane parallel to and slightly spaced from the plane of the front face of the disc 1, such that each tongue radially extends inward beyond the edge of the hole 2. Two pairs of axial slots 5 are provided in the collar 1*c*, each pair being located on sides of a respective arm 1*d*, to increase the capacity of the arms to be deformed or displaced, thus giving to the tongues 1*e* a radial mobility.

It is to be noted that the disc is provided with openings 6 located opposite the arms 1*d*, which permit the extraction of the disc from the mould during the manufacture of the disc, when the body of the disc, the arms 1*d* and the small tongues 1*e* are fabricated as an integral unit.

To mount the disc in place onto the machine, the disc is manually gripped by means of its collar 1*c* and pushed onto the shaft 3. Due to a bevel 7 on the end of stub journal 3*a* of the shaft 3 (FIG. 3), and due to a rounded lateral face 8 on the ends of the small tongues 1*e*, these tongues move radially under the effect of the force exerted thereon by the shaft and engage resiliently into an annular groove 9 of the journal 3*a*. Removal of the disc is easily achieved due to a bevel 10 of the outer lateral face of the groove 9.

Since the disc 1 is integrally moulded with arms 1*d* and tongue 1*e*, it is inexpensive. Moreover, its mounting on the machine and its dismounting are very convenient.

It is to be noted that the central hole 2 of the disc 1 is provided with a metallic ring or bushing 11. This ring serves to ensure that the hole 2 is uniform in diameters, which is very important for permitting the disc to operate satisfactorily. However, this ring 11 serves a supplementary function in that the openings 6 in the disc, located opposite the arms 1*d* and the small tongues 1*e*, need not open into the central hole 2, which would be required in order to mould the disc if the ring 11 were not provided. Without ring 11 the small tongues 1*e* would stick, during the moulding, on the portion of the disc situated thereunder, that would necessitate extending the opening 6 radially. With the metallic ring 11, on the contrary, it is easy, during the manufacturing process, to prevent the small tongues sticking on this ring since the ring is metallic. Thus, the ring is also an element of the mould. In mounting and dismounting the disc on the shaft of the printing machine, the small tongues 1*e* move while slidably engaging the front axial face of the ring.

The number of the small tongues 1*e* can be greater than two, for example three or four, equally distributed angular around the hole 2.

I claim:

1. A printing wheel disc having a metallic ring defining a central hole within which a drive shaft of a printing machine is received for mounting said disc thereon, said disc having a plurality of tongue members integral therewith extending radially inwardly beyond the edge of the whole and being substantially parallel to the plane of the disc, an annular collar coaxial with said hole and projecting substantially perpendicular from a face of said disc said collar being interrupted by a pair of spaced slots for each tongue member, defining a portion of said collar therebetween, a resiliently deformable arm means connecting each tongue member to said collar protion enabling resilient displacement of said tongue members for engagement and disengagement of said tongue members with a groove in said drive shaft, said ring having an axial face on which said tongue members are slidably engaged for said radial displacement.

2. The disc as claimed in claim 1, wherein a pair of said tongue members are located in diametric opposition.

* * * * *